US006896541B2

(12) United States Patent
Benson

(10) Patent No.: US 6,896,541 B2
(45) Date of Patent: May 24, 2005

(54) INTERFACE CONNECTOR THAT ENABLES DETECTION OF CABLE CONNECTION

(75) Inventor: Anthony Joseph Benson, Roseville, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/369,832

(22) Filed: Feb. 18, 2003

(65) Prior Publication Data

US 2004/0161966 A1 Aug. 19, 2004

(51) Int. Cl.[7] ..... H01R 3/00
(52) U.S. Cl. ..... 439/489; 439/607; 439/188
(58) Field of Search ..... 439/188, 488, 439/489, 490, 502, 504, 452, 607, 620

(56) References Cited

U.S. PATENT DOCUMENTS

| | | | | |
|---|---|---|---|---|
| 4,468,612 A | | 8/1984 | Starr | |
| 5,434,516 A | | 7/1995 | Kosco | |
| 5,624,275 A | | 4/1997 | Fukuda | |
| 5,741,151 A | * | 4/1998 | Youngers | 439/489 |
| 5,743,760 A | | 4/1998 | Inaba et al. | |
| 5,947,773 A | * | 9/1999 | Karam | 439/676 |
| 6,077,104 A | | 6/2000 | Chang et al. | |
| 6,283,799 B1 | | 9/2001 | Fukase et al. | |
| 6,595,801 B1 | * | 7/2003 | Leonard et al. | 439/607 |

* cited by examiner

*Primary Examiner*—Tho D. Ta
*Assistant Examiner*—James R. Harvey

(57) ABSTRACT

A connector apparatus is adapted for determining cable connection status and comprises a first connector. The first connector comprises a plurality of contacts capable of coupling to a corresponding plurality of conductors in a cable, a substrate supporting the plurality of contacts, and an insulator layer encasing at least a portion of the individual contacts of the plurality of contacts and mutually isolating the contacts. The first connector further comprises a shroud enclosing the plurality of contacts, the substrate, and the insulator layer. The shroud is electrically conductive and separated into first and second electrically isolated segments. Each of the first and second segments is electrically connected to respective first and second reference contacts.

18 Claims, 10 Drawing Sheets

INTERFACE CONNECTOR THAT ENABLES DETECTION OF CABLE CONNECTION

RELATED APPLICATIONS

The disclosed system and operating method are related to subject matter disclosed in the following co-pending patent applications that are incorporated by reference herein in their entirety: (1) U.S. patent application Ser. No. 10/370,358, entitled "High Speed Multiple Port Data Bus Interface Architecture"; (2) U.S. patent application Ser. No. 10/370,414, entitled "High Speed Multiple Ported Bus Interface Control"; (3) U.S. patent application Ser. No. 10/370,361, entitled "High Speed Multiple Ported Bus Interface Expander Control System"; (4) U.S. patent application Ser. No. 10/370,326, entitled "High Speed Multiple Ported Bus Interface Port State Identification System"; (5) U.S. Pat. No. 6,810,439, entitled "System and Method to Monitor Connections to a Device"; and (6) U.S. patent application Ser. No. 10/370,364, entitled "High Speed Multiple Ported Bus Interface Reset Control System."

BACKGROUND OF THE INVENTION

A computing system may use an interface to connect to one or more peripheral devices, such as data storage devices, printers, and scanners. The interface typically includes a data communication bus that attaches and allows orderly communication among the devices and the computing system. A system may include one or more communication buses. In many systems a logic chip, known as a bus controller, monitors and manages data transmission between the computing system and the peripheral devices by prioritizing the order and the manner of device control and access to the communication buses. Control rules, also known as communication protocols, are imposed to promote the communication of information between computing systems and peripheral devices. For example, Small Computer System Interface or SCSI (pronounced "scuzzy") is an interface, widely used in computing systems, such as desktop and mainframe computers, that enables connection of multiple peripheral devices to a computing system.

In a desktop computer SCSI enables peripheral devices, such as scanners, CDs, DVDs, and Zip drives, as well as hard drives to be added to one SCSI cable chain. In network servers SCSI connects multiple hard drives in a fault-tolerant cluster configuration in which failure of one drive can be remedied by replacement from the SCSI bus without loss of data while the system remains operational. A fault-tolerant communication system detects faults, such as power interruption or removal or insertion of peripherals, allowing reset of appropriate system components to retransmit any lost data.

A SCSI communication bus follows the SCSI communication protocol, generally implemented using a 50 conductor flat ribbon or round bundle cable of characteristic impedance of 100 Ohm. SCSI communication bus includes a bus controller on a single expansion board that plugs into the host computing system. The expansion board is called a Bus Controller Card (BCC), SCSI host adapter, or SCSI controller card.

In many systems, a capability to detect attachment of a cable or connector is useful. For example, a system capable of detecting whether a device is attached at the end of a transmission line is useful to supply proper termination impedance to the line. In a specific example, a commonly used parallel input/output (PIO) system for computers, the SCSI protocol interface, requires termination at each end, and only at each end, in a chain of devices. Despite some standardization, many proprietary variations, proposed extensions, and improvements exist that make uncertain the actual configuration of a system. SCSI signal lines may be single ended or differential, either low voltage differential or high voltage differential. Furthermore, a variety of termination alternative exist such as passive termination internal to a device, typically socketed or jumpered for removability, or active termination internal to a device. Other termination alternatives include manually switchable or automatically switchable internal termination, either active or passive, or external termination requiring an additional external connector with termination circuitry plugged into the extra external connector.

The multiple connector and termination schemes have led to confusion and the possibility of excessive termination within a device chain. Specifically, a user typically cannot determine from external examination whether a particular device has an internal termination and whether any internal termination is socketed, jumpered, or switched, either active or passive. If a terminator is missing, or a terminator is enabled when improper, the SCSI bus may not function reliably.

Plug and Play SCSI standard attempts to simplify connector and termination configurations by specifying one standard connector for external devices and specifying that termination for external devices are external to the devices. Specifically, active external termination is required with terminator power supplied by a designated line in the SCSI bus. Each external device must have two visible external connectors. When external devices are chained, only one connector can remain open and the open connector must receive the one external active termination circuit. This simplification still requires manual intervention, requires a separate part with additional cost, and creates a risk of performance loss if the part is lost. A customer must purchase a separate terminator plug, including active circuitry and a connector, and properly install the terminator plug on the one open external device connector.

SUMMARY OF THE INVENTION

In accordance with some embodiments of the illustrative system, a connector apparatus is adapted for determining cable connection status and comprises a first connector. The first connector comprises a plurality of contacts capable of coupling to a corresponding plurality of conductors in a cable, a substrate supporting the plurality of contacts, and an insulator layer encasing at least a portion of the individual contacts of the plurality of contacts and mutually isolating the contacts. The first connector further comprises a shroud enclosing the plurality of contacts, the substrate, and the insulator layer. The shroud is electrically conductive and separated into first and second electrically isolated segments. Each of the first and second segments is electrically connected to respective first and second reference contacts.

In accordance with other embodiments, a connector apparatus comprises a housing for encasing a plurality of contacts capable of coupling to a corresponding plurality of conductors in a cable. The housing comprises an electrically conductive layer, the electrically conductive layer being separated into mutually isolated segments that are electrically connected upon attachment to a mating connector.

In accordance with a further embodiment, a method of detecting connection status comprises encasing a plurality of contacts capable of coupling to a corresponding plurality of conductors in a cable, and conducting electricity along the encasing means, mutually isolating the conducted electricity into two segments. The method further comprises attaching a mating connector to the plurality of contacts and electrically coupling the mutually isolated segments upon the attachment to the mating connector.

BRIEF DESCRIPTION OF THE DRAWINGS

Embodiments of the invention relating to both structure and method of operation, may best be understood by referring to the following description and accompanying drawings.

DETAILED DESCRIPTION

Figure 1:
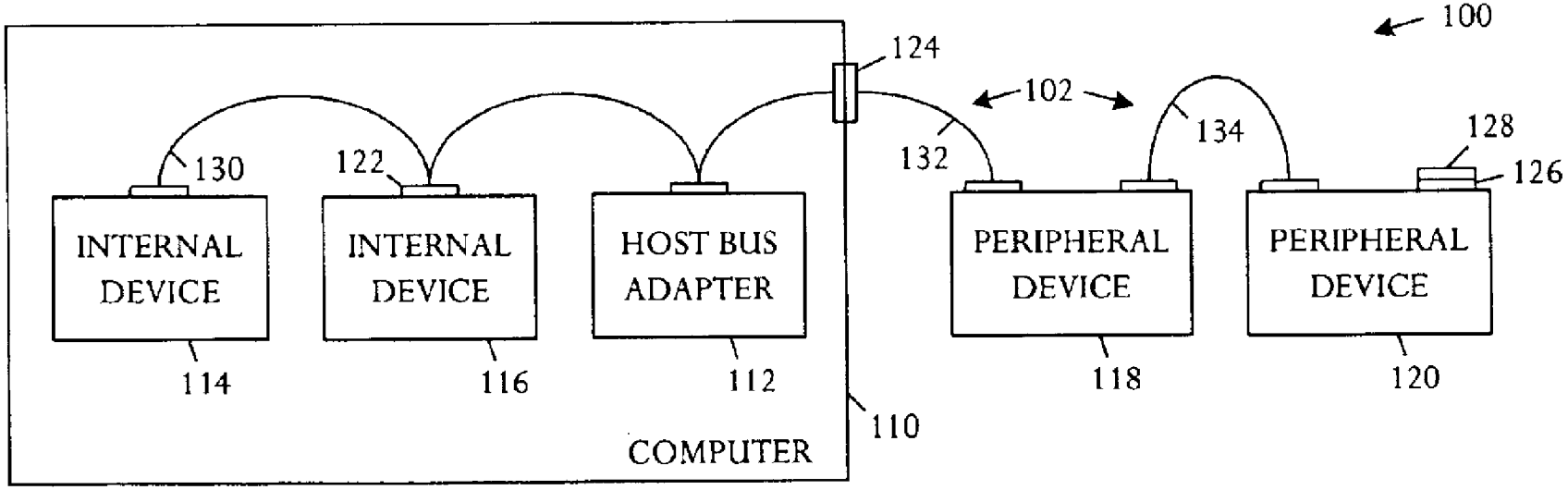
FIG. 1 is a schematic block diagram showing an example of a computer system including a bus system.

Some bus standards, for example the SCSI bus standard, define ends of the bus by bus termination. Bus termination is used to set a negation state when no device is driving, also called biasing, and to match impedance to interconnect media impedance. A termination circuit successfully terminates the bus by complying with specifications for biasing and impedance matching. A termination circuit is termed "enabled" when successfully applying bus termination. Conversely, a termination circuit is "disabled" when not supplying bias and impedance matching functions. A switchable terminator is a terminator capable of being disabled by disconnecting all signal lines, optionally including DIFFSENS, by an electronic switch.

What is desired is a system in which a last device in a chain can sense when nothing is plugged into one of the two external connectors and, if so, automatically switches in an internal active termination circuit.

One approach to automatic detection of external connector presence is to access a line that is normally grounded by every device on the bus and, for a particular external device, internally pull the line high instead of low. Accordingly, if the line is at ground, an external device is connected. If the line is high, an external device is not connected in a system with all devices connected using the same method. However, SCSI systems may include one or more devices that do not comply with the standard method, so that a high line does not indicate with certainty that the external device is not connected. What is desired is a capability to automatically sense connection of a device with certainty. In some embodiments what is further desired is a capability, in a SCSI system, for automatic connection sensing that is standard for all devices.

What is also desired is a general capability, extending beyond the SCSI standard, for automatic detection of the presence of a mating connector.

In a two-port bus architecture that specifies a first port with at least one host connection and a second port with another host or terminator connection, a cable sensing connector facilitates algorithms that determine the correctness of the system configuration.

Many devices are available in the two-port architecture, for example HP Jamaica drives, HP DS2300, and front ends of HP SC10 Disk System, HP Surestore HVD10, HP DS2100, and other devices and systems, all manufactured and sold by Hewlett-Packard Company of Palo Alto, Calif. Two-port architecture devices are also available from other manufacturers. On-board termination can be added to two-port architectures to simplify user interfaces and reduce overall system cost.

A ground pin isolation technique can be used to determine when to activate or deactivate the terminator at each port. A separated connector can be used to determine validity of the overall system configuration. The system configuration is invalid with no termination at the end of the bus. The invalid condition occurs when a cable is added to a system or disconnected from a system in a way that extends the bus past the termination point or disconnects from the termination at the end of the bus.

A system can integrate a separated connector that enables the system to sense when an unconnected cable is connected to the system and respond by resetting the bus to avoid data corruption until the configuration is corrected.

Figure 9A:
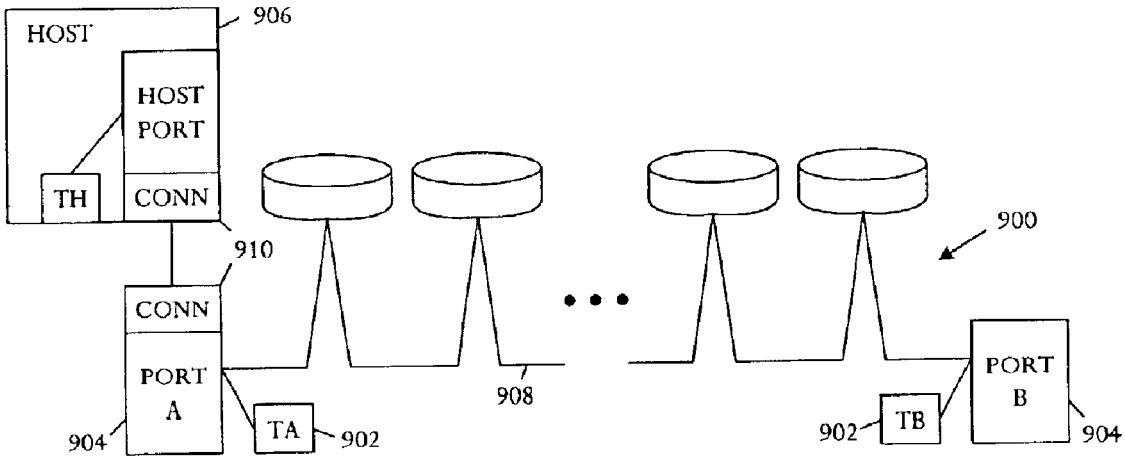
FIGS. 9A, 9B, and 9C are schematic block diagrams showing examples of bus system configurations that illustrate utility of the disclosed separated connector.

Referring to FIG. 9A, a system 900 supports on-board termination and includes termination circuitry TA 902 associated with Port A 904. Port A 904 is not activated due to a connection to the Host 906 that supplies termination at the end of the bus 908. On-board termination circuitry TB 912 associated with Port B 914 senses no connection to a Host 906 or external terminator and responds by activating termination.

Figure 9B:
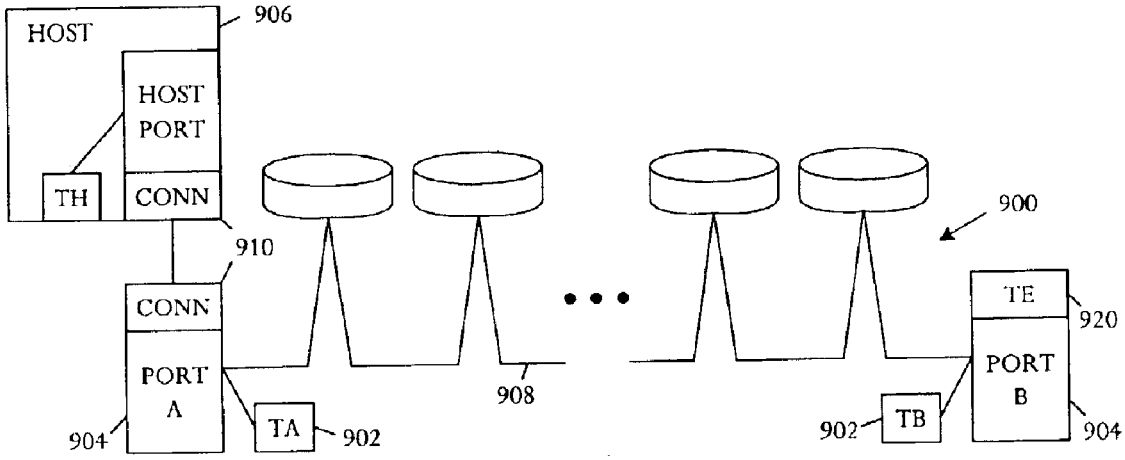

Referring to FIG. 9B, terminator TE 920 is added to the bus system 900. Status of termination circuitry TA 902 does not change while termination circuitry TB 912 becomes deactivated by sensing of an external connection from terminator TE 920.

Figure 9C:
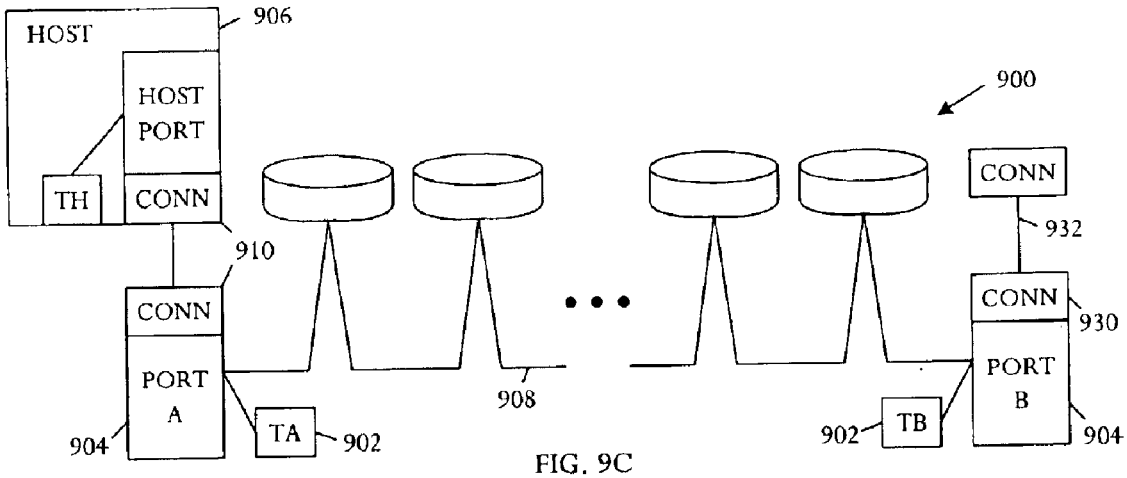

Referring to FIG. 9C, the bus system 900 is further modified by replacing the terminator 920 with a cable connection 930. A cable 932 with an unconnected end 934 is connected to Port B 914 so that the bus 908 is improperly terminated since Port B 914 is no longer connected to an external terminator or host. Improper termination is a common consequence when a system is under reconfiguration or troubleshooting. In the illustrative configuration of improper termination, the system 900 with a conventional connector 910 incorrectly continues operating without acknowledging the improper termination and the deteriorated mode operating conditions that can cause data corruption. The difficulty arises from extension of the bus 908 past the terminator TB 914, an improper termination that can cause signal degradation.

What is desired is a modified connector that can be used at Port A 904 and Port B 914 that is capable of generating an indication of the connection status of a port. What is further desired is a method for usage in combination with the modified connector that enables the system 900 to determine whether the bus 900 is properly configured. Changes in bus status indications determine how long to reset the bus 908 and timing of bus reset disable.

In an illustrative embodiment, a female connector that is separated into two electrically isolated parts attains the desired functionality. A connector shroud of the female connector is bisected, isolating metal ground pins and flanges on either side of the connector. In some configurations, one ground pin can be pulled high through a resistor to a voltage plane. The other ground pin is tied to ground. The pin that is pulled high can be monitored to detect connection of a mating connector to the female connector, for example using monitoring circuitry. When a cable with a male connector is connected to the female connector, the male connector shroud makes electrical contact to both sides of the female connector, electrically connecting the high and low sides of the female connector, enabling sensing that a cable is connected to the female connector.

A capability to determine whether a cable is connected to a female connector, without the other end of the cable being connected to anything, enables monitoring of the female connector for extensions of the bus that are not properly terminated. The capability enables bus configuration control functionality to isolate the connector, avoiding data corruption.

In some embodiments, the bus is a SCSI bus. In some embodiments, the female connector is a VHDCI connector.

The illustrative connector and associated method enables detection of bus configuration without monitoring of isolated pins on the female connector to determine when the pins are pulled to ground. The pins will only be pulled to ground if the other end of the cable is connected to a terminator or host bus adapter.

Referring to FIG. 1, a schematic block diagram shows an example of a computer system 100 including a bus system 102 that can connect a computer 110 to multiple peripheral devices. The peripheral devices can include internal devices 114 and 116 internal to the computer 110, and external peripheral devices 118 and 120. The illustrative computer 110 comprises a host bus adapter 112 and the two internal devices 114 and 116. Examples of internal devices 114 and 116 may be internal disk drives, compact disk read-only memory (CD-ROM) devices, digital versatile disk ROM (DVD-ROM) devices, tape drives, any many others. External peripheral devices 118 and 120 may include printers, scanners, and others. Any suitable number of internal devices 114 and 116, and external devices 118 and 120 may be connected to the bus system 102.

The bus system 102 may be compliant with a standard, such as the Small Computer Systems Interface (SCSI) standard, or others. In one example, bus termination is to be supplied by a device at the end of the bus, internal device 116 in the illustrative embodiment. A cable 130, such as a ribbon cable, can connect internal devices 114 and 116, with a single connector 122 for each device. External devices 118 and 120 can be connected by a series of double-ended cables 132 and 134. A first double-ended cable 132 connects a connector 124 on the computer 110 to external device 118. A second double-ended cable 134 connects external device 118 and external device 120. External device 120 has no cable attached, an open connector 126 that may be terminated with a terminator plug 128. In one example, a Plug and Play SCSI standard mandates usage of the terminator plug 128. Alternatively, the external device 120 can be terminated internally to the device 120.

Figure 2A:
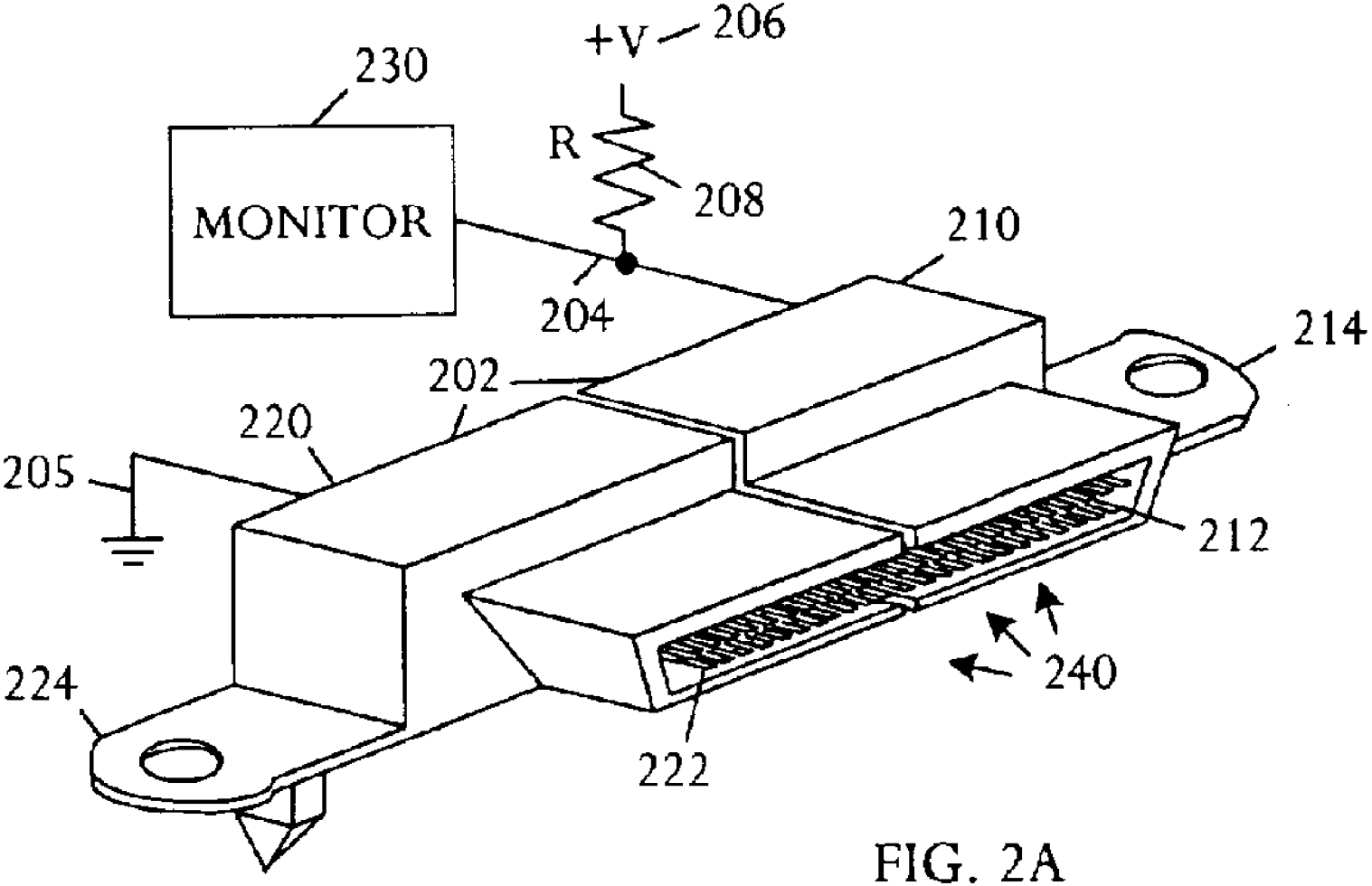
FIGS. 2A and 2B are schematic pictorial and circuit diagrams that illustrate an embodiment of the disclosed female connector with corresponding male connector not installed and installed, respectively.

Referring to FIG. 2A, a schematic pictorial and circuit diagram illustrates an embodiment of the disclosed connector 200. The connector 200 comprises a plurality of contacts 240 capable of coupling to a corresponding plurality of conductors in a cable. A substrate supports the plurality of contacts 240 and an insulator layer encases at least a portion of the individual contacts 240, mutually isolating the contacts 240. In an illustrative embodiment, the connector 200 is a female connector comprising a shroud 202 separated into two electrically isolated parts 210 and 220. The isolated parts 210 and 220 have mutually isolated metal ground contacts or pins 212 and 222, respectively, and mutually isolated flanges 214 and 224, respectively, on either side 210 and 220 of the connector 200. One ground pin, for example ground pin 212, can be pulled high through a resistor 208 to a voltage plane V+ 206. The other ground pin, in the example ground pin 222, is connected to ground potential 205. The electrically isolated parts 210 and 220 are electrically connected when a corresponding male connector is installed. Part 210 is connected to a sense line 204 that is pulled to the voltage plane V+ 206 by resistor 208. Part 220 is connected to ground potential 205. With no male connector installed, the sense line 204 is pulled high. Circuitry 230 monitors the sense line 204 and detects the high state V+ when a male connector is not installed.

Figure 2B:
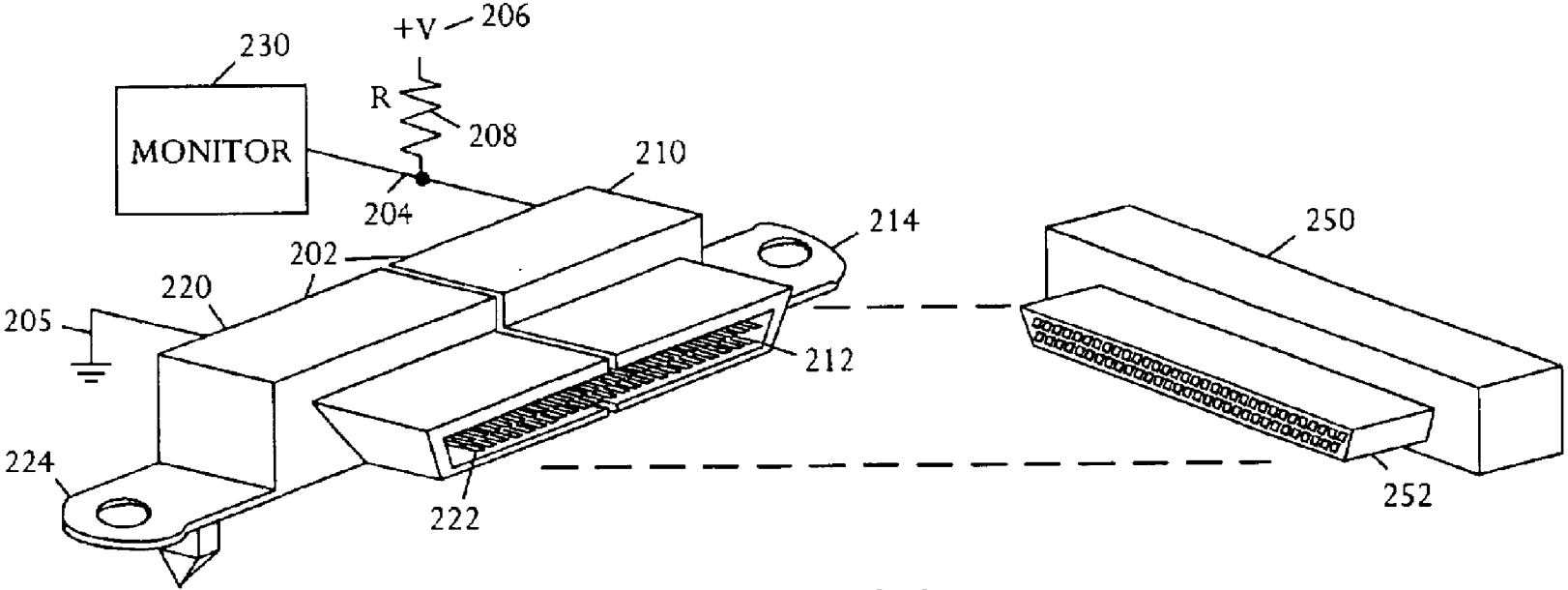

Referring to FIG. 2B, a male connector 250 is installed into the female connector 200. A connector shroud 252 of the male connector 250 makes electrical contact to both parts 210 and 220 of the female connector 200. With the male connector 250 installed, the sense line 204 is pulled low through the male connector shroud 252 to ground potential 205. The circuitry 230 senses the cable attachment to the female connector 200. In the example of a SCSI bus connection, connection of the sense pin 204 to ground complies with the SCSI standard.

In the illustrative example, the connectors 200 and 250 are, respectively Very High Density Cable Interconnect (VHDCI), female and male connectors.

Figure 3:
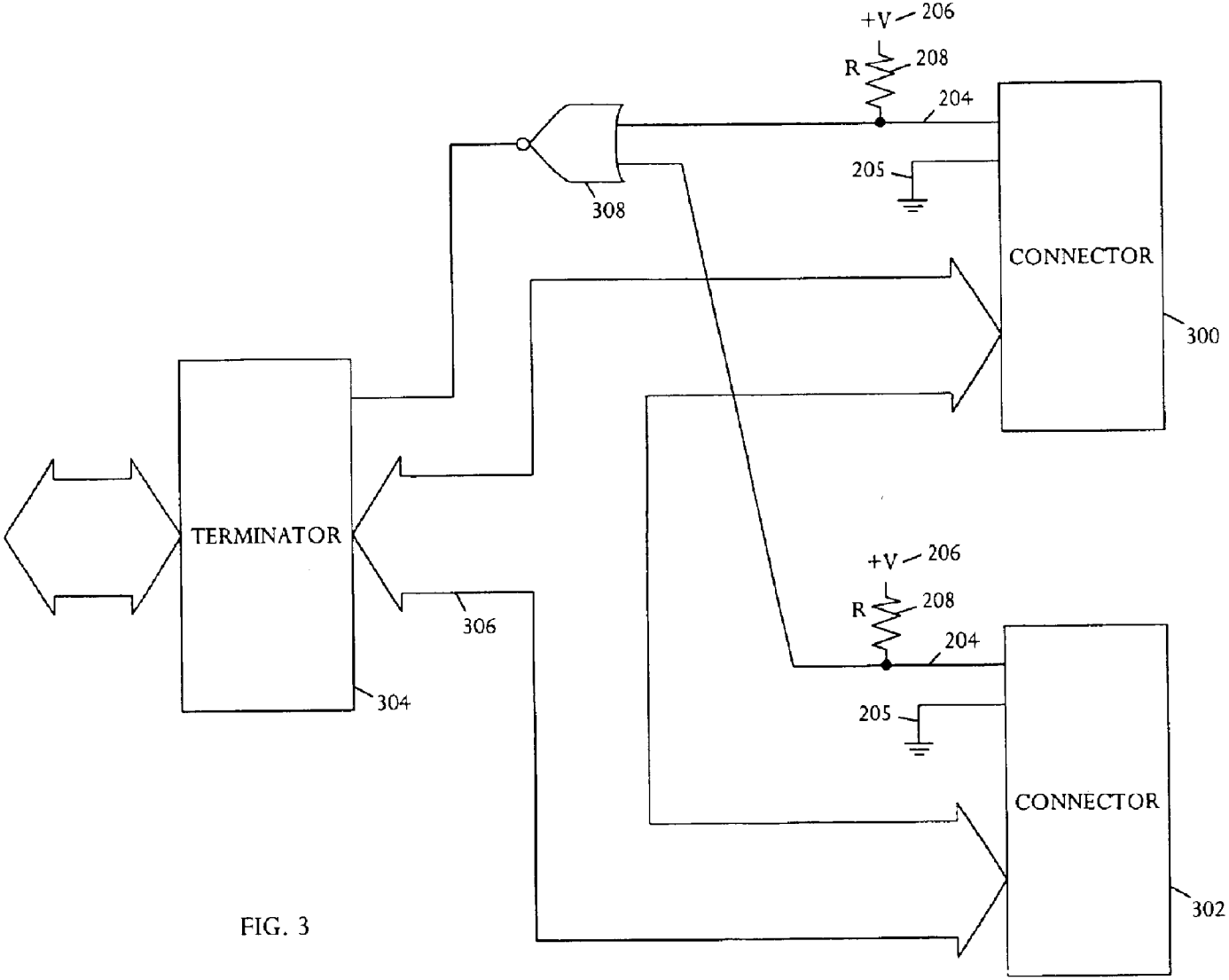
FIG. 3 is a schematic block diagram showing an example of usage of the illustrative female connector and the manner of operation to enable and disable an active termination circuit.

Referring to FIG. 3, a schematic block diagram shows an example of the usage of the illustrative female connector and the manner of operation to enable and disable an active termination circuit. In the example, connectors 300 and 302 each contain at least one female connector as illustrated in FIGS. 2A and 2B. Each connector 300 and 302 has a sense line 204 pulled high if no associated male mating connector is attached, and pulled to ground if an associated male mating connector is attached. A terminators 304A and 304B, for example a SCSI terminator, terminate bi-directional data lines 306 for a single connector. One terminator bank for connectors 300 and 302. Terminator 304 may be a commercially available active terminator circuit, or a functionally similar component. In other configurations, an electrically controlled switch may be used to switch a passive terminator circuit in or out. Terminator 304A and 304B have enable/disable input control signals. Voltage level depends on the particular terminator. Discrete control logic or FPGA/PLD chips can be used to monitor the connector sense lines, enable/disable termination, and control SCSI bus reset signals based on the desired operational technique.

The illustrative female connector enables detection of whether a corresponding male connector is installed. The illustrative female connector enables detection whether the configuration includes only one device with the connector, or some or all devices connected to the bus have the connector. Accordingly, the female connector can attain the desired functionality whether or not adopted as a standard. If one of the female connectors 300 and 302 are open, an external termination plug installed into the open female connector 300 or 302 forms an electrical contact in the manner of a corresponding male connector, automatically disabling the terminator 304 so that the external termination plug supplies termination.

In a SCSI application, the female connector contact is specified as a ground contact. For alternative applications, the line at the contact can be specified as a non-ground voltage with one part of the connector connected to the voltage and the other part resistively coupled to ground. In the alternative applications, mating connector presence is detected as a voltage on the resistor coupled to ground, or a current passing through the resistor. In further alternative examples, the two female connector parts can be monitored using any continuous measurement with a circuit being open if no mating connector is present and closed if a mating connector is present. In other examples, the connector can be a signal contact with one part connected to the signal and the second part connected to a high impedance signal detection circuit. If a mating connector is present, a signal is detected at the signal detection circuit.

Figure 4:
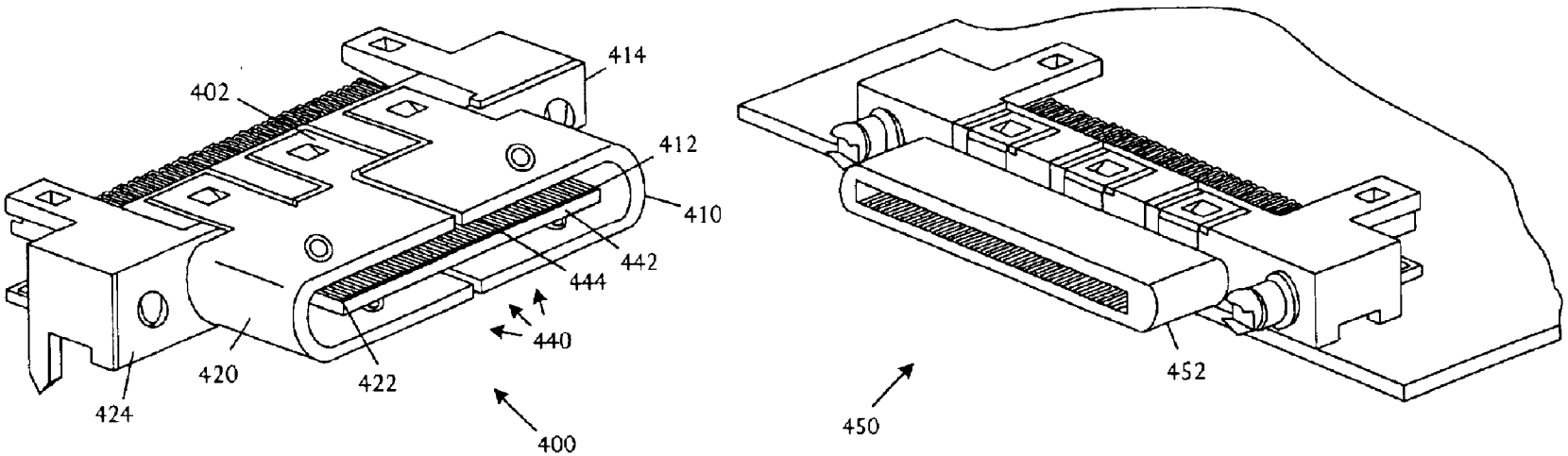
FIG. 4 is a pictorial drawing illustrating another example of a connector that enables detection of a cable connection.

Referring to FIG. 4, a pictorial drawing shows another example of a connector 400 that enables detection of a cable connection. In an illustrative example, a cable-side connector 400 is a 4 shielded 68-conductor SCSI device connector with two rows of ribbon contacts 440 connected 0.8 mm apart. The connector 400 comprises a plurality of contacts 440 capable of coupling to a corresponding plurality of conductors in a cable. A substrate 442 supports the plurality of contacts 440 and an insulator layer 444 encases at least a portion of the individual contacts 440, mutually isolating the contacts 440. The connector 400 comprises a shroud 402 separated into two electrically isolated parts 410 and 420. The isolated parts 410 and 420 have mutually isolated metal ground contacts or pins 412 and 422, respectively, and mutually isolated flanges 414 and 424, respectively, on either side 410 and 420 of the connector 400.

The cable-side connector 400 can be attached to a device-side connector 450. A connector shroud 452 of the device-side connector 350 makes electrical contact to both segments 410 and 420 of the cable-side connector 400. With the connectors attached, a sense line is pulled low through the device-side connector shroud 452 to ground potential enabling a monitor to sense cable attachment.

Figure 5:
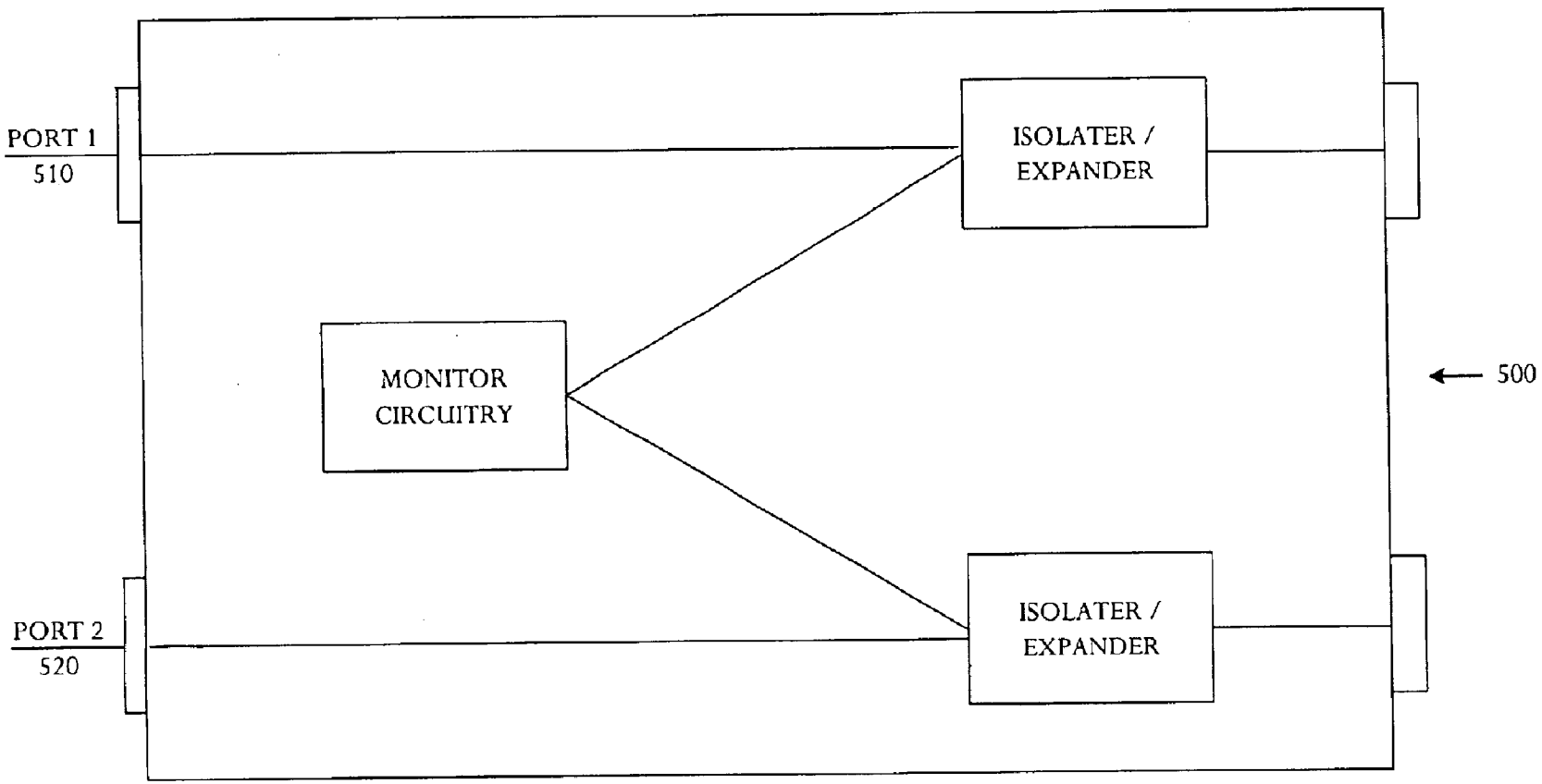
FIG. 5 is a schematic block diagram showing an example of a bus architecture that can utilize the illustrative connector to determine whether a cable is connected or unconnected.

Referring to FIG. 5, a schematic block diagram shows an example of a bus architecture 500 that can utilize the illustrative connector to determine whether a cable is connected or unconnected. The illustrative bus architecture 500 enables valid SCSI connection for a dual ported controller card with a low voltage differential (LVD) SCSI data bus. In a specific embodiment SCSI standards specify a term power range between 3.0 volts and 5.25 volts, and a diff_sense signal voltage range between 0.7 volts and 1.9 volts to indicate an LVD connection. The SCSI standards further specify that at least one port is connected to a Host Bus Adapter (HBA) that supplies termination, term power, and diff_sense signal. The other port can be connected to another HBA or a terminator.

Term power and diff_sense signals are common signals that run through both ports A 510 and B 520 as in the SCSI specification (SPI through SP-4). If only one port is connected to an operating Host Bus Adapter (HBA), the term power and diff_sense signals remain although a valid front-end connection no longer exists. Accordingly both ports 510 and 520 are monitored to assure both have valid connections.

Some systems may use "auto-termination" circuitry to determine whether the SCSI bus has proper termination based on current sensed in any of multiple SCSI signals. Difficulties with the auto-termination approach result from usage of a variety of components with different electrical behavior and a resulting variation in current. The illustrative technique does not use current-sensing auto-termination techniques and presumes that a user has properly configured the Host Bus Adapter (HBA) with termination.

Figure 6:
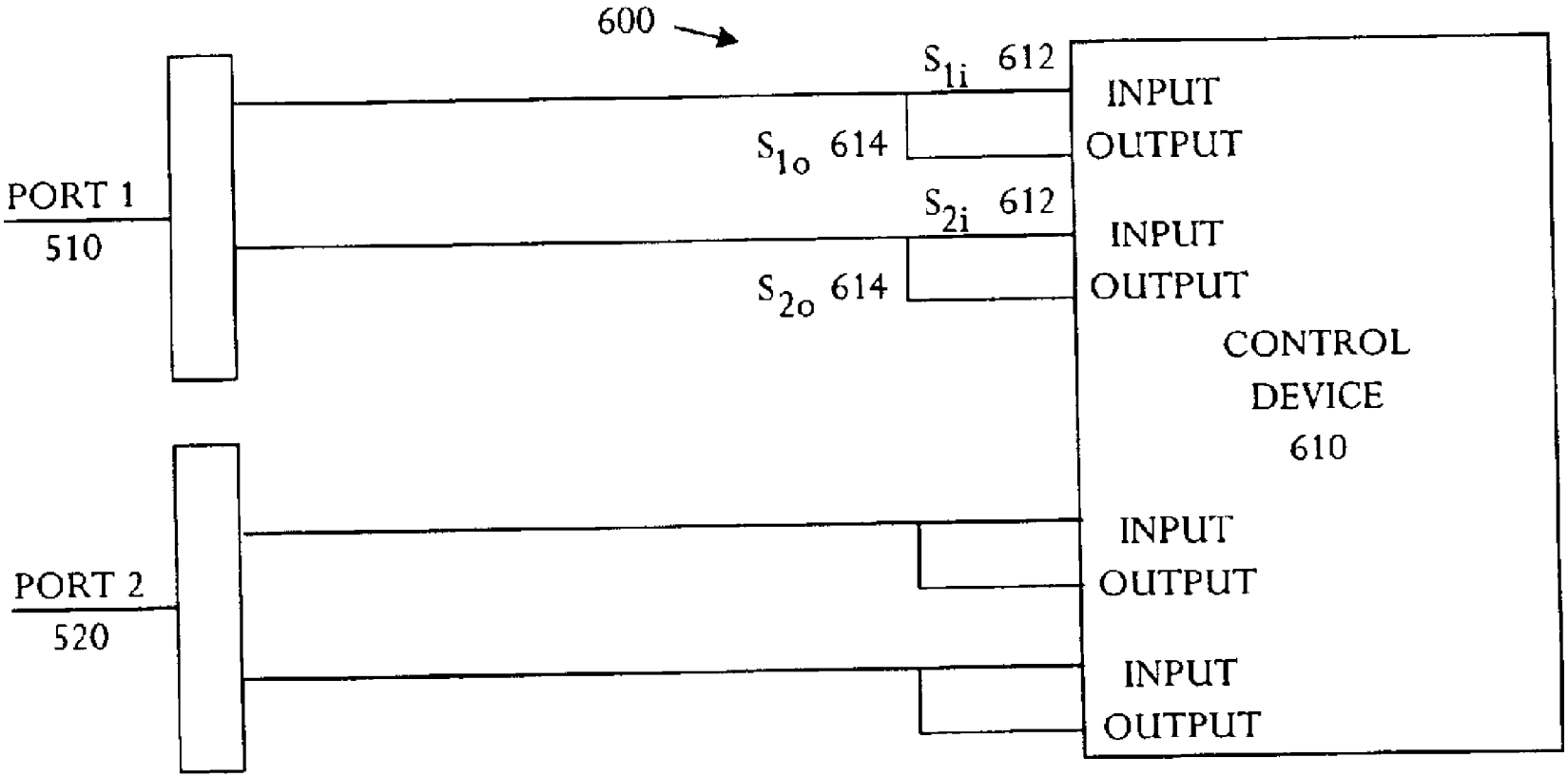
FIG. 6 is a schematic circuit diagram that can be used to determine whether proper connections are made in the bus architecture shown in FIG. 5.

The technique determines whether a proper front-end connection exists by having the individual ports 510 and 520 isolate multiple ground pins, pull the ground pins high, and monitor the ground pins to determine whether the pins are pulled low due to a connection. At least two pins are isolated to avoid a condition in which an HBA also has one ground pin isolated for the same reason. The technique utilizes the circuit diagrammed in FIG. 6 to manage the manner in which a pin that is not pulled down due to the pin's condition as isolated and pulled up on the other end.

The individual signals connected to an isolated ground pin on a port is connected to two ports of a control device 610, such as a Field Programmable Gate Array (FPGA) or Programmable Logic Device (PLD). One control device monitoring port, for example $S_{1i}$ or $S_{2i}$, is configured as an input port, and a second port, for example $S_{1o}$ or $S_{2o}$, is set as an output port and tri-stated (disabled) when not pulling the signal low. At least two isolated ground pins are allocated per connector port. If one signal is pulled low as a result of a connection, that signal alerts the control device 610 to pull the second line down so that the other device will also sense the connection. Logic executing on the control device 610 transfers to another state and waits for at least one signal to go high, indicating a disconnection. Upon disconnection, all output signals $S_{1o}$ and $S_{2o}$ are tri-stated.

Referring to TABLE I, a truth table shows state relationships for two input signals and two output signals with state signals associated with the output signals.

TABLE I

| | Input S2(I2) | Input S1(I1) | State 1 | State 0 |
|---|---|---|---|---|
| **0** | **0** | **0** | **0** | **0** |
| **1** | **0** | **0** | **0** | **1** |
| **2** | **0** | **0** | **1** | **0** |
| 3 | 0 | 0 | 1 | 1 |
| **4** | **0** | **1** | **0** | **0** |
| **5** | **0** | **1** | **0** | **1** |
| **6** | **0** | **1** | **1** | **0** |
| 7 | 0 | 1 | 1 | 1 |
| **8** | **1** | **0** | **0** | **0** |
| **9** | **1** | **0** | **0** | **1** |
| **10** | **1** | **0** | **1** | **0** |
| 11 | 1 | 0 | 1 | 1 |
| **12** | **1** | **1** | **0** | **0** |
| **13** | **1** | **1** | **0** | **1** |
| **14** | **1** | **1** | **1** | **0** |
| **15** | **1** | **1** | **1** | **1** |

Valid states are indicated in bold.

The occurrence of a connection at signal $S_{1i}$ causes control device 610 to transition signals $S_{1i}$, $S_{2i}$, $S_{2o}$, $S_{1o}$ through states 0-4-6-14 as shown in Table II.

TABLE II

| Path | Input $S_{2I}$ | Input $S_{1i}$ | State of Output $S_{2o}$ | State of Output $S_{1o}$ |
|---|---|---|---|---|
| 0 | 0 | 0 | 0 | 0 |
| 4 | 0 | 1 | 0 | 0 |
| 6 | 0 | 1 | 1 | 0 |
| 14 | 1 | 1 | 1 | 0 |

When a disconnection occurs at signal $S_{1i}$, the state of signals $S_{1i}$, $S_{2i}$, $S_{2o}$, $S_{1o}$ through paths 14-10-8-0 as shown in Table III.

TABLE III

| Path | Input $S_{2I}$ | Input $S_{1i}$ | State of Output $S_{2o}$ | State of Output $S_{1o}$ |
|---|---|---|---|---|
| 14 | 1 | 1 | 1 | 0 |
| 10 | 1 | 0 | 1 | 0 |
| 8 | 1 | 0 | 0 | 0 |
| 0 | 0 | 0 | 0 | 0 |

When a connection is sensed at Input S2, the state transition of signals $S_{1i}$, $S_{2i}$, $S_{2o}$, $S_{1o}$ includes paths 0-8-9-13 as shown in Table IV.

TABLE IV

| Path | Input $S_{2i}$ | Input $S_{1i}$ | State of Output $S_{2o}$ | State of Output $S_{1o}$ |
|---|---|---|---|---|
| 0 | 0 | 0 | 0 | 0 |
| 8 | 1 | 0 | 0 | 0 |
| 9 | 1 | 0 | 0 | 1 |
| 13 | 1 | 1 | 0 | 1 |

Signals $S_{1i}$, $S_{2i}$, $S_{2o}$, $S_{1o}$ transition through paths 13-5-4-0, as shown in Table V, when a disconnection occurs at input port S2.

TABLE V

| Path | Input $S_{2i}$ | Input $S_{1i}$ | State of Output $S_{2o}$ | State of Output $S_{1o}$ |
|---|---|---|---|---|
| 13 | 1 | 1 | 0 | 1 |
| 5 | 0 | 1 | 0 | 1 |
| 4 | 0 | 1 | 0 | 0 |
| 0 | 0 | 0 | 0 | 0 |

Information regarding whether a connection or disconnection is occurring is used to determine the next state. State information follows from the fact that when a disconnection occurs at signal $S_{1i}$, or a connection occurs at signal $S_{2i}$, *the states of signals* $S_{1i}$, $S_{2i}$, $S_{1o}$, $S_{2o}$ transition through path 8 (1000). Path 4 (0100) is another common path that is transitioned during a disconnection at signal $S_{1o}$, and a connection at port $S_{2o}$. State machines 700 and 800 shown in FIGS. 7 and 8, respectively, can be used to determine the next transition state. Then state information, in turn, can be used to determine: (1) whether a connector is being attached to or removed from circuit 600 shown in FIG. 6, (2) the next state based on the values of $S_{1i}$, $S_{2i}$, and (3) whether a connection is being made or broken.

Figure 7:
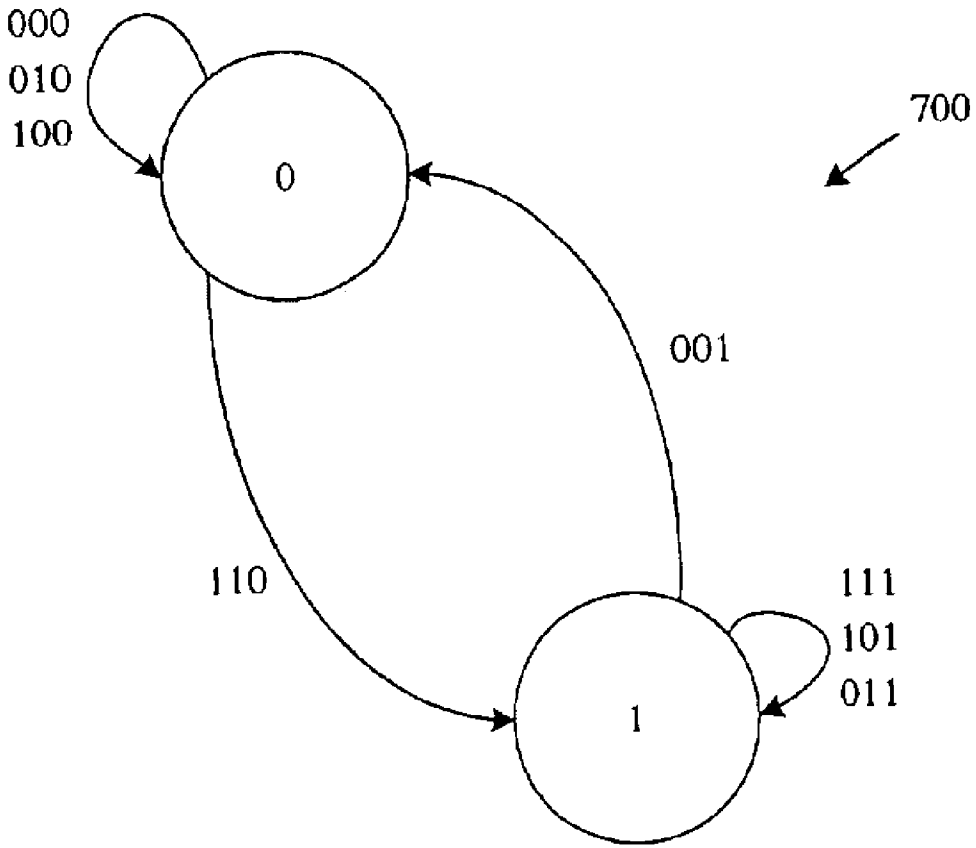
FIG. 7 is a state diagram showing an embodiment of a state machine capable of determining whether a connector is being attached or removed from the circuit shown in FIG. 6.
Figure 8:
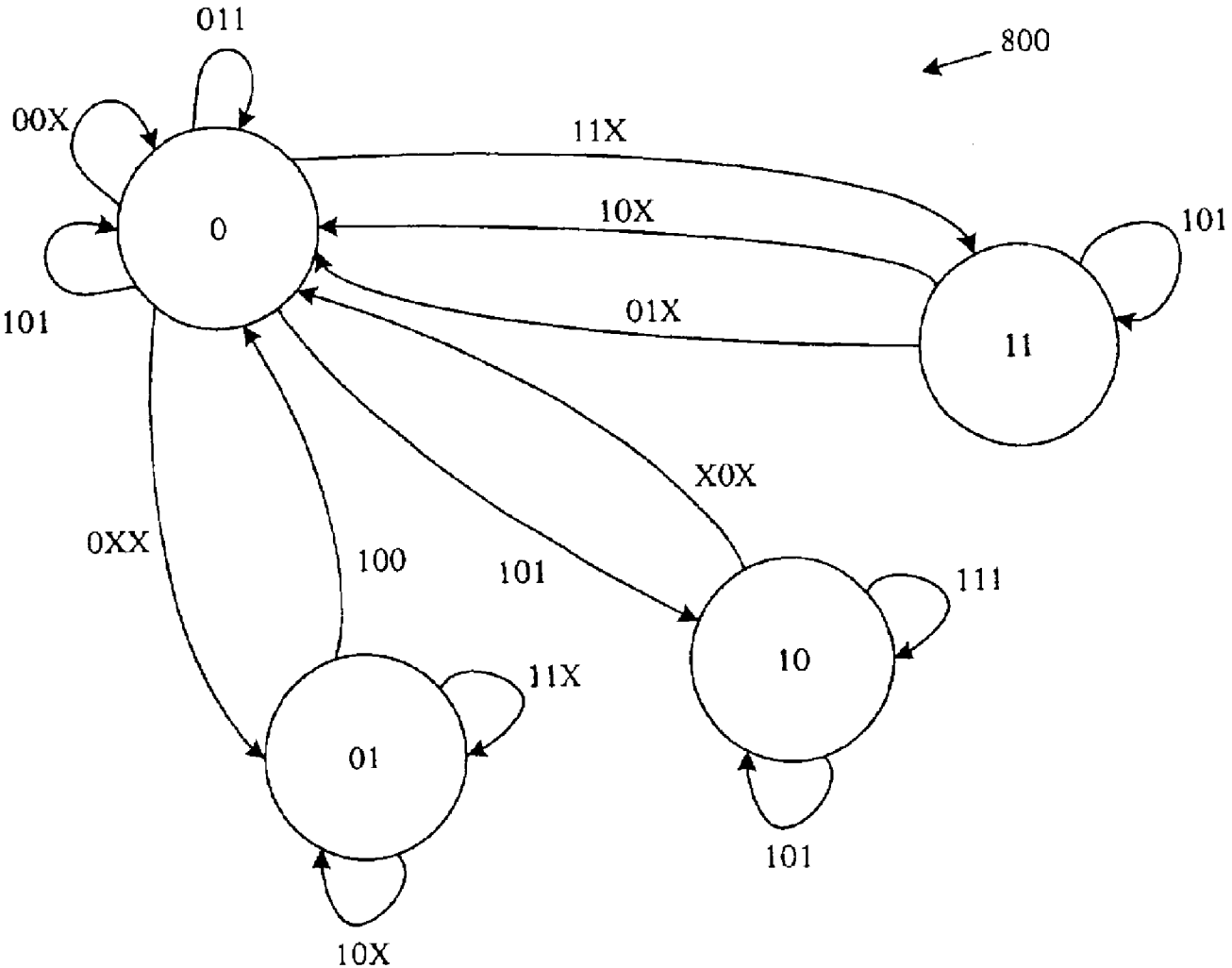
FIG. 8 is a state diagram that depicts a state machine embodiment capable of determining whether a connector is properly attached to a device.

The embodiment of state machine 700 shown in FIG. 7 includes a disconnected state 0 and a connected state 1. The circles and arrows describe how state machine 700 moves from one state to another. In general, the circles in a state machine represent a particular value of the state variable. The lines with arrows describe how the state machine transitions from one state to the next state. One or more boolean expressions are associated with each transition line to show the criteria for a transition from one state to another. If the boolean expression is TRUE and the current state is the state at the source of the arrowed line, the state machine will transition to the destination state on the next clock cycle. The diagram also shows one or more sets of the values of the output variables during each state next to the circle representing the state.

In state machine 700, the input signals $S_{1i}$, $S_{2i}$, and connection status is indicated by a Boolean expression with three numbers representing in order from left to right, the state of the input signals $S_{2i}$ and $S_{1i}$, and connection status, where each number can have the value of 1 or 0 depending on the corresponding state of the parameter. For example, States 000, 010 and 100 indicate no connection to a device. A transition from disconnected to connected occurs when State 110 is detected. Similarly, States 011, 101, and 111 indicate a connection to a device, and a transition from connected to disconnected occurs when State 001 is detected.

State machine 800 determines the state of signals $S_{1i}$, $S_{2i}$, $S_{1o}$, and $S_{2o}$ based on connection status and a change in either input signal $S_{1i}$ or $S_{2i}$. In some embodiments, the transitions between states follow the paths shown in Tables IV, V, VI, and VII. Input signals $S_{1i}$, $S_{2i}$ and connection status are indicated by a Boolean expression with three numbers representing in order from left to right the state of the input signals $S_{2i}$ and $S_{1i}$, and connection status. Each number can have the value of 1 or 0 depending on the corresponding state of the parameter. States of the output signals $S_{2o}$ and $S_{1o}$ are shown as a Boolean expression in the state circles 00, 01, 10 and 11.

Although the illustrative example describes a particular type of bus connector, the claimed elements and techniques may be utilized with other bus connector types or configurations. For example, although the illustrative connector has a conductive shroud that is separated into isolated parts that are electrically connected when a mating connector is attached, other structures in the connector, such as a housing or casing, may be separated to supply the utilized isolation. The illustrative buses, connectors, and methods are particularly described in utilization with a SCSI bus standard. The claimed elements and methods may be used under other interface standards. For example, although the disclosed system is described in terms of a SCSI bus system, the illustrative connector can be used for general detection of the presence of a mating connector in any bus system and is not limited to SCSI systems.

What is claimed is:

1. A connector apparatus adapted for determining cable connection status, the connector apparatus comprising:

a first connector comprising:

a plurality of contacts capable of coupling to a corresponding plurality of conductors in a cable;

a substrate supporting the plurality of contacts;

a shroud shielding the plurality of contacts, the substrate, and the insulator layer, the shroud being electrically conductive and separated into first and second electrically isolated segments, each of the first and second segments being electrically connected to respective first and second reference contacts; and a second connector capable of attaching to the first connector, the second connector having a singlepiece electrically conductive shroud so that attachment of the first and second connectors electrically connects the first segment to the second segment of the first connector shroud whereby the first and second segments are no longer electrically isolated.

2. The connector apparatus according to claim 1 wherein the first connector further comprises:

first and second conductive flanges respectively coupled to the first and second reference contacts.

3. The connector apparatus according to claim 1 wherein:

the first connector is a female connector and the second connector is a male connector.

4. The connector apparatus according to claim 1 wherein:

the first connector is a Very High Density Cable Interconnect (VHDCI) female connector and the second connector is a VHDCI male connector.

5. The connector apparatus according to claim 1 further comprising:

a sense line coupled to the first reference contact;

a resistor coupled between a supply voltage and the sense line; and a ground reference coupled to the second reference contact.

6. The connector apparatus according to claim 1 further comprising:

a sense line coupled to the first reference contact;

a resistor coupled between a supply voltage and the sense line;

a ground reference coupled to the second reference contact; and a monitoring circuitry coupled to the sense line and capable of detecting attachment and nonattachment of the second connector from the first connector.

7. The connector apparatus according to claim 1 wherein:

the connector apparatus is a Small Computer Systems Interface (SCSI) compliant connector device.

8. A connector apparatus comprising:

a housing for encasing a plurality of contacts capable of coupling to a corresponding plurality of conductors in a cable, the housing comprising an electrically conductive layer, the electrically conductive layer being separated into segments that are mutually isolated but electrically connected upon attachment to a mating connector;

a substrate located within the housing; and a plurality of contacts located on and supported by the substrate.

9. The connector apparatus according to claim 8 further comprising:

first and second reference contacts contained by the housing and electrically connected respectively to first and second segments of the mutually isolated segments.

10. The connector apparatus according to claim 8 further comprising:

first and second conductive flanges coupled to the housing and electrically connected respectively to first and second segments of the mutually isolated segments.

11. The connector apparatus according to claim 8 wherein:

the connector apparatus is a female connector.

12. The connector apparatus according to claim 8 wherein:

the connector apparatus is a Very High Density Cable Interconnect (VHDCI) female connector.

13. The connector apparatus according to claim 8 further comprising:

first and second reference contacts contained by the housing and electrically connected respectively to first and second segments of the mutually isolated segments;

a sense line coupled to the first reference contact;

a resistor coupled between a supply voltage and the sense line; and a ground reference coupled to the second reference contact.

14. The connector apparatus according to claim 8 further comprising:

first and second reference contacts contained by the housing a end electrically connected respectively to first and second segments of the mutually isolated segments;

a sense line coupled to the first reference contact;

a resistor coupled between a supply voltage and the sense line;

a ground reference coupled to the second reference contact; and a monitoring circuitry coupled to the sense line and capable of detecting attachment and nonattachment of the second connector from the first connector.

15. A connector apparatus comprising:

means for encasing a plurality of contacts capable of coupling to a corresponding plurality of conductors in a cable;

means coupled to the encasing means for conducting electricity;

means for mutually isolating first and second segments of the conducting means;

means for electrically coupling the first segment to the second segment of the previously mutually isolated segments upon attachment to a mating connector;

means for coupling a first segment of the mutually isolated segments to a supply voltage through a resistance;

means for coupling a second segment of the mutually isolated segments to a voltage reference; and means for monitoring electrical status at the first segment.

16. A connector apparatus comprising:

a female connector including a connector shroud, a plurality of pins shielded by the shroud including ground pins, and flanges on opposing sides of the female connector, the shroud being separated into two sections that are mutually electrically isolated, electrically isolating ground pins and flanges on the opposing connector sides; and a male connector including an electrically-conductive connector shroud that, when engaged to the female connector forms a conductive connection between the two female connector sections.

17. The connector apparatus according to claim 16 further comprising:

a resistor coupled between a first ground pin on a first of the opposing connector sides and a voltage plane;

a connection from a second ground pin on a second of the opposing connector sides to ground; and monitoring circuitry coupled to the first ground pin that detects mutual engagement and disengagement of the male and female connectors.

18. The connector apparatus according to claim 16 wherein:

the female and male connectors are Very High Density Cable Interconnect (VHDCI) connectors.

* * * * *

UNITED STATES PATENT AND TRADEMARK OFFICE

CERTIFICATE OF CORRECTION

PATENT NO. : 6,896,541 B2
APPLICATION NO. : 10/369832
DATED : February 18, 2003
INVENTOR(S) : Anthony Joseph Benson It is certified that error appears in the above-identified patent and that said Letters Patent is hereby corrected as shown below:

Claim 14, Column 12, line 15, after “housing” delete “a end” and insert therefor --and--

Signed and Sealed this

Sixth Day of January, 2009

JON W. DUDAS
*Director of the United States Patent and Trademark Office*

UNITED STATES PATENT AND TRADEMARK OFFICE

CERTIFICATE OF CORRECTION

PATENT NO. : 6,896,541 B2
APPLICATION NO. : 10/369832
DATED : May 24, 2005
INVENTOR(S) : Anthony Joseph Benson It is certified that error appears in the above-identified patent and that said Letters Patent is hereby corrected as shown below:

Claim 14, Column 12, line 15, after “housing” delete “a end” and insert therefor --and--

This certificate supersedes the Certificate of Correction issued January 6, 2009.

Signed and Sealed this

Third Day of February, 2009

John Doll

JOHN DOLL
*Acting Director of the United States Patent and Trademark Office*